United States Patent [19]

Jutras

[11] Patent Number: 4,676,032

[45] Date of Patent: Jun. 30, 1987

[54] INFLATABLE WALL STRUCTURE

[76] Inventor: Pierre Jutras, 111 rue de la Barre, Suite 11, Longueuil, Quebec, Canada, J4K 2T8

[21] Appl. No.: 546,653

[22] Filed: Oct. 28, 1983

[51] Int. Cl.[4] ..... E04B 1/34

[52] U.S. Cl. ..... 52/2; 52/86

[58] Field of Search ..... 52/2 C, 2 I, 2 J, 2 K, 52/2 N, 2 P, 86; 47/17; 244/125, 128, 131

[56] References Cited

U.S. PATENT.DOCUMENTS

| | | | |
|---|---|---|---|
| 511,472 | 12/1893 | Sumovski | 52/2 |
| 1,881,296 | 10/1932 | Potez | 244/131 |
| 1,988,085 | 1/1935 | Orlando | 244/131 |
| 2,016,054 | 10/1935 | Sentell | 5/458 |
| 2,636,457 | 4/1953 | Finlay et al. | 52/2 |
| 2,657,716 | 11/1953 | Ford | 139/410 |
| 2,698,020 | 12/1954 | Phane | 52/2 |
| 2,743,510 | 5/1956 | Mauney et al. | 428/12 |
| 2,753,019 | 7/1956 | Phane | 52/2 |
| 2,832,362 | 4/1958 | Critoph | 52/86 |
| 2,837,101 | 6/1958 | Bary | 52/2 |
| 3,030,640 | 4/1962 | Gosman | 5/455 |
| 3,057,368 | 10/1962 | Seaman | 52/2 |
| 3,123,085 | 3/1964 | Demarteau | 52/2 |
| 3,169,542 | 2/1965 | Neumark | 52/2 P |
| 3,227,169 | 1/1966 | Fisher | 52/2 |
| 3,247,627 | 4/1966 | Bird | 52/2 J |
| 3,256,649 | 6/1966 | Webb | 52/2 |
| 3,277,614 | 10/1966 | Marie | 52/2 |
| 3,292,338 | 12/1966 | MacLarence et al. | 52/746 |
| 3,432,609 | 3/1969 | Duvall | 52/2 I |
| 3,523,055 | 8/1970 | Lemelson | 52/2 I |
| 3,608,250 | 9/1971 | Ducrocq | 52/2 |
| 3,779,847 | 12/1973 | Turner | 156/156 |
| 3,854,253 | 12/1974 | Slowbe | 52/2 |
| 3,973,363 | 8/1976 | LaPorte et al. | 52/2 |
| 4,004,380 | 1/1977 | Kwake | 52/2 |
| 4,096,669 | 6/1978 | Pabst | 135/119 |
| 4,114,325 | 9/1978 | Hochstein | 52/2 K |
| 4,186,530 | 2/1980 | Fraioli | 52/2 |
| 4,271,641 | 6/1981 | Kawaguchi | 52/2 I |

FOREIGN PATENT DOCUMENTS

| | | | |
|---|---|---|---|
| 2231311 | 1/1975 | France | 47/17 |
| 48-346847 | 10/1973 | Japan . | |
| 49-6175 | 2/1974 | Japan . | |
| 50-21843 | 7/1975 | Japan . | |
| 50-21842 | 7/1975 | Japan . | |
| 779813 | 7/1957 | United Kingdom | 52/86 |
| 896416 | 5/1962 | United Kingdom | 52/86 |

*Primary Examiner*—John E. Murtagh
*Assistant Examiner*—Andrew Joseph Rudy
*Attorney, Agent, or Firm*—Samuel Meerkreebs

[57] ABSTRACT

A roof formed from a self-supporting inflatable structure including a polyhedron frame made from tension cables interconnected and joining at nodes and an envelope surrounding the frame. Anchoring skirts extend from each node line to predetermined lines on the panels forming the envelope. The polyhedron frame is such size as to provide an arch shaped roof covering an area to be covered, and when the envelope is inflated, and sufficient internal air pressure is therein maintained, all of the tension cables are under tension and the overall structure becomes rigid, stable and capable of resisting deformation caused by external forces applied to it.

8 Claims, 8 Drawing Figures

INFLATABLE WALL STRUCTURE

BACKGROUND OF THE INVENTION

1. Field of the Invention

The present invention relates to a self-supporting inflatable dual wall structure and more specifically of a type utilized for forming roof structures and other lightweight, large span, self-supporting, open structures.

2. Description of the Prior Art

Numerous attempts have been made to provide a pneumatic dual wall roof or cover made of lightweight fabric or synthetic material. One type includes a cellular construction as shown in U.S. Pat. Nos. 3,247,627, Bird, 1966; 3,030,640, Gosman, 1962; 3,779,847, Turner, 1973; 511,472, Sumovski, 1893; 2,837,101, Bary, 1958; 3,256,649, Webb, 1966; 3,292,338, MacClarence et al, 1966; 4,186,530, Fraioli, 1980; 3,973,363, LaPorte et al, 1976 and 3,227,169, Fischer, 1966.

Another form of dual wall inflatable structure is the type shown in U.S. Pat. No. 4,004,380, Kwake, 1977, in which two membranes form the inflatable structure and tension rods or tension cables extend between anchor points on the membranes. Examples of this type of structure are shown in U.S. Pat. Nos. 3,123,085, Demarteau, 1964; 2,753,019, Phane, 1956; 2,743,510, Mauney et al, 1956; 2,698,020, Phane, 1954; 2,657,716, Ford, 1953; 2,636,457, Finlay et al, 1953; 2,016,054, Sentell, 1935; and 3,277,614, Marié, 1966.

The Marié patent, for instance, shows a framework of cables forming a beam or girder surrounded by a cover, the cover including prisoner cables attached to nodes formed from connecting cables resulting from the triangular structure of the framework. The resulting structure shown in FIGS. 7 and 8, is a complex unidirectional inflated girder or beam.

SUMMARY OF THE INVENTION

It is an aim of the present invention to provide an inflatable structure which is lightweight yet self-supporting and having a structural integrity which is sufficient to provide a cover or roof spanning a large area. It is contemplated that an inflatable structure of the type described can span a large area without intermediate supports if the structure is for instance, an arch having a somewhat parabolic curve and resting only on its edges. The span can be far greater than that attained presently by conventional single membrane air supported building using a similar type of canvas material and far lighter than any type of construction.

A construction in accordance with the present invention comprises an inflatable double wall pneumatic structure including a polyhedron cable frame assembly. The frame comprises a pair of spaced-apart grids with each grid made up of cable tension elements in quadrilateral patterns with each tension element connected to intersecting tension elements at nodes in the plane of the respective grid. Cable tension elements extend between the grids and are connected to corresponding nodes in the respective grids. The grids define the upper and lower surfaces of the cable frame, and an air impervious flexible closed envelope totally encloses the cable frame. The walls of the envelope include spaced-apart anchor means connected to corresponding nodes on the respective grids of the cable frame such that when the envelope is inflated and subject to pneumatic pressure, the tension elements forming the cable frame will be under tension causing the cable frame to assume its intended shape.

In a more specific embodiment of the present invention, there is provided a pneumatic self-supporting roof structure adapted to cover a predetermined surface, the roof structure comprising an arch-shaped pneumatically inflated envelope enclosing a similarly shaped polyhedron cable frame and extending laterally across the area to be covered and longitudinally thereof. The envelope and cable frame assembly is essentially composed of a plurality of identical adjacent sections connected side by side with each section extending in the lateral direction between the parallel structures which are longitudinally bordering the area to be covered. Each section includes a top and bottom strip of impermeable material, and each strip having its parallel longitudinal edges provided with continuous connecting means adapted to connect adjacent strips at respective seams to form top and bottom envelope panels respectively. Each section includes also, in between the top and bottom strips, a series of somewhat rectahedron-shaped cable sub-frames connected end to end, mutually sharing the connecting common faces, each such sub-frame made up of flexible cable elements defining the edges of the rectahedron thus formed and nodes defining the junction of the cable edge elements. A tension skirt extends continuously from and along the inward side of the seams connecting two adjacent section strips and is fitted with regularly spaced anchoring means to be anchored to an arch line of successive nodes respectively on top and bottom sides of the cable frame section. Side covers and end covers complete the envelope and are connected along the edges of the strip assemblies of the top and bottom panels. The tension skirt and panel section assemblies and the flexible cable elements are so dimensioned that when the envelope and cable frame assembly is completed and inflated to maintain an internal pressure, all of the cable elements are under tension, thereby providing a self-supporting arch-shaped roof.

When the envelope is inflated and the cable elements are under tension, the structure becomes quite rigid, and when these flexible cable elements forming the polyhedron cable frame are properly selected and an adequate number and location of diagonal cable struts are provided and fixed to their proper pair of nodes, the arch-shaped sections are like rigid arch trusses. The span of a roof formed by these arch sections structurally connected to one another successively may be quite large and certainly the span can cover, without any intermediate supports, an area greater than any known single or multiple inflatable membrane structures built today. The structure can be utilized to cover stadiums or tennis courts, etc. The preferred curvature of the arches is parabolic or catenary. The structure can be adapted to various loads such as in northern climates where snow weight must be supported during winter months. If a greater load must be carried the air pressure within the envelope can be increased to meet the required loads. It is evident that by increasing the air pressure within the envelope, the tension in the cable elements of the structure will be increased and so will its rigidity and load-bearing capacity.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
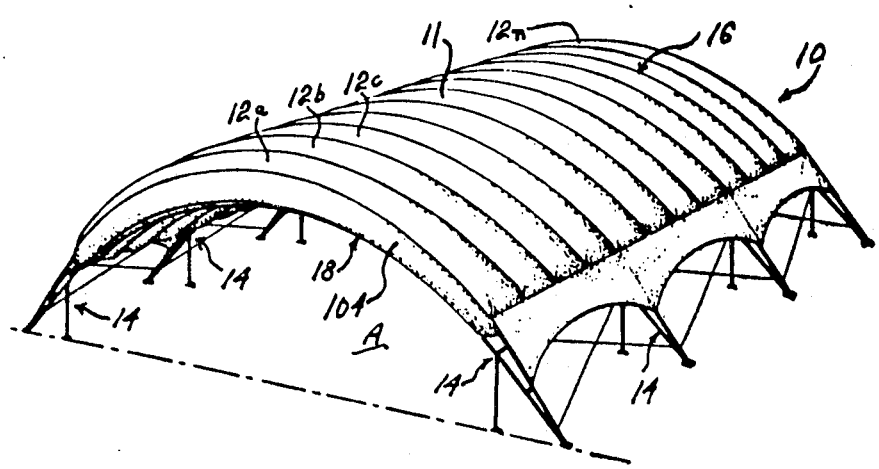
FIG. 1 is a perspective view of an arch-shaped roof embodying the present invention.
Figure 2:
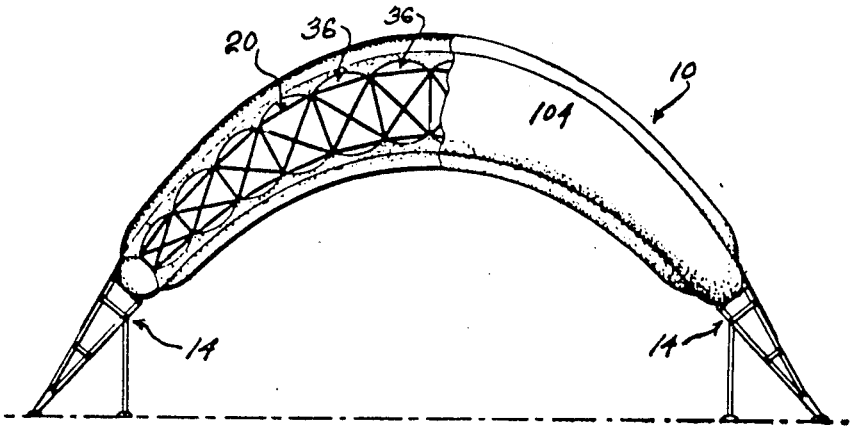
FIG. 2 is an end elevation of the roof shown in FIG. 1.

Referring now to the drawings and particularly to FIGS. 1 and 2 of the drawings, there is shown a large roof structure 10 including an envelope 11, and including a number of side-by-side arch sections 12, identified 12*a*, 12*b*, 12*c* . . . 12*n*. The complete inflated roof 10 is supported at each side edge by support members 14. The roof is meant to cover an area A. The roof 10 can be contemplated as being made up of a top impermeable panel of flexible material 16 and a bottom panel 18.

The complete roof envelope 11 can be better described by referring to the individual identical sections 12*a*, 12*b*, 12*c*, . . . 12*n*. The sections are joined together to form the complete impermeable air-tight envelope with an internal cable framework 20 which is made up of side-by-side rectahedron shaped-frames connected in end-to-end series in each sections 12*a*, 12*b*, 12*c*, . . . 12*n*.

Figure 3:
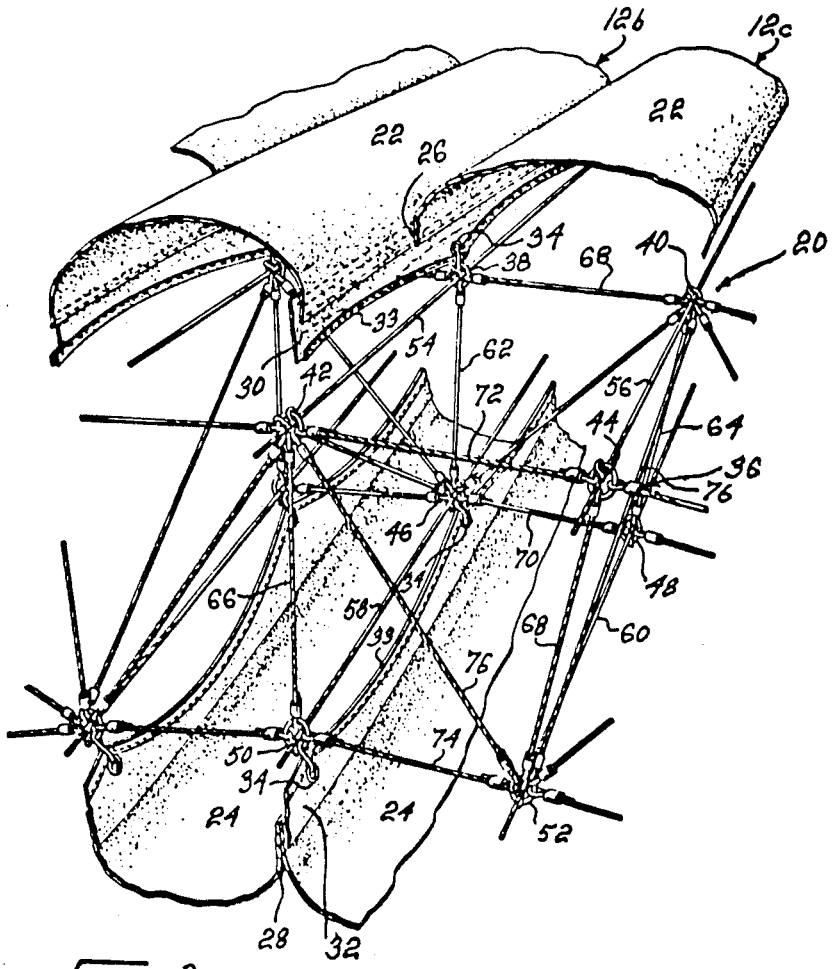
FIG. 3 is a fragmentary enlarged perspective view showing details of the present invention.

Typical sections 12*b* and 12*c* are illustrated in FIG. 3. Each section 12*b* and 12*c* includes an upper strip 22 and a lower strip 24. Adjacent strips 22, for instance, are connected along their respective edges by means of threads, in the present embodiment, to form a seam 26. Similarly, the strips 24 are connected along their edges to form seams 28. Each strip is made of a suitable material such as vinyl reinforced with nylon, Kevlar or Dacron or other suitable strong woven material. Each strip 22 and 24 extends from one side of the envelope 11 to the other, that is, the complete length of a section 12*b* and 12*c*, or from one support member 14 to the other.

Figure 6:
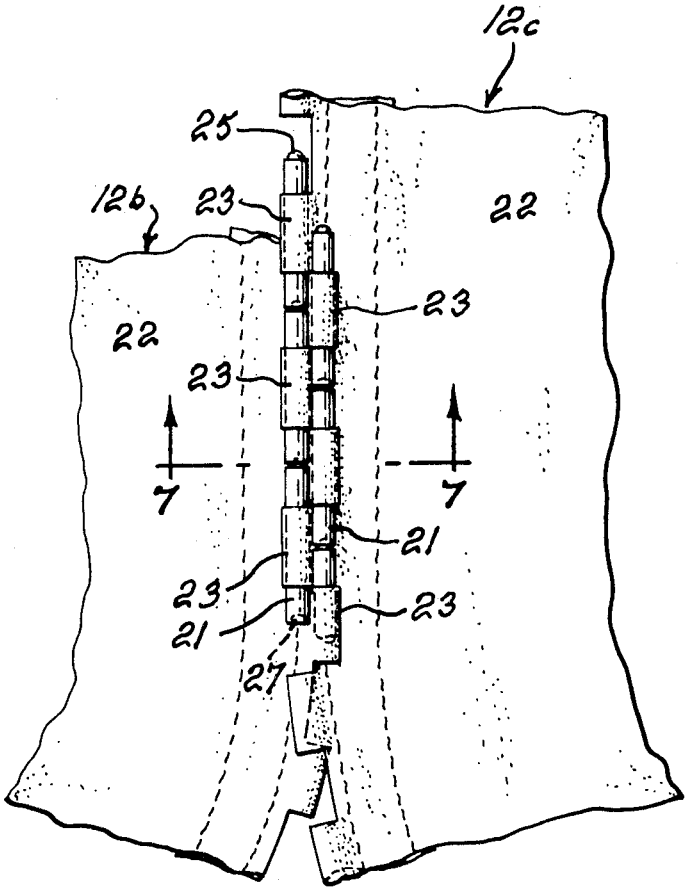
FIG. 6, is an enlarged plan view of a detail of the present invention.
Figure 7:
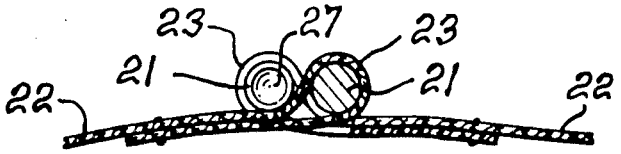
FIG. 7, is a vertical cross-section taken along line 7—7 of FIG. 6.

Selected canvas strips 22 and 24 could be cut longitudinally into two parts and provided with an interlocking fastener system as shown in FIGS. 6 and 7, which would divide the panels into modules of several sections. In this case, the cut edges of the strips 22 and 24 may be folded over and sewn and cuts making loops 23 may be provided in which dowels 21 are fixed and adapted to interlock as shown in FIGS. 6 and 7. Each dowel 21 may have a rounded end 25 and a complementary female socket portion 27 adapted to receive the rounded end 25 of an adjacent dowel 21. The tension on the strip material forces the interlocking of the dowels and provides for an air-tight seam.

Referring back to FIG. 3, each of the seams 26 and 28 is further provided with a anchoring skirt 30 and 32 respectively. These anchoring skirts are of strong woven material and include a belting or overlapped webbing 33 to reinforce the edges thereof. In the present embodiment, the anchoring skirts 30 and 32 are scalloped to form gradual arch-shaped segments as illustrated with an annular reinforcing eyelet ring defining an anchor position opening 34 at the apex of each scallop.

Figure 8:
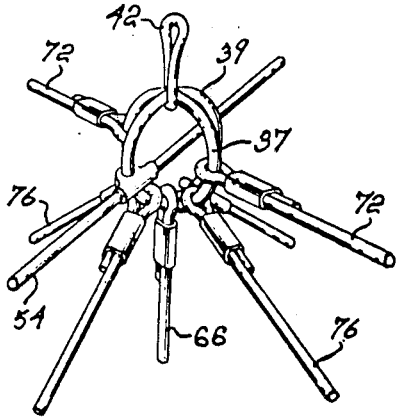
FIG. 8, which is on the same sheet of drawings as FIG. 3, is an enlarged perspective view of another embodiment of a detail as shown in FIG. 3.

In FIG. 3, a complete rectahedron shaped frame portion or sub-frame 36 is illustrated having respective nodes 38, 40, 42, 44, 46, 48, 50 and 52. These nodes 38 . . . 52 form the respective corners of the rectahedron sub-frame 36. These nodes may include a single annular ring 37 or a pair of rings 37 and 39 welded or otherwise connected together such that the center of each ring coincides and the rings are in 90° planes as shown in FIG. 8. Lengths of tension cable extend between each node 38 . . . 52 and form the edges of the hectahedron sub-frame 36. For instance, spanwise cables 54, 56, 58, 60, which are running along the direction of section 12*c*, are connected respectively to their designated nodes by means of conventional hardware pieces 54*a*, 72*a*, etc. These hardware pieces may be any state of the art device for such application. Vertical cable elements 62, 64, 66 and 68 are also connected to their respective nodes. (To name each respective node would burden the present description, but the location of each cable element is identified in the drawings.) Lengthwise of the overall structures extending tension cables 68, 70, 72 and 74 are also illustrated extending between respective corner nodes while diagional struts 76 (also tension cables) may be provided at different locations to reinforce selected rectahedron sub-frames. These diagonal cable struts 76 are not essential and are used generally to reinforce certain regions of the overall polyhedron cable frame structure to further resist the urge to deform the structure due to outside and asymmetrical loading, such as wind or snow.

As is evident from FIG. 3, adjacent side-by-side rectahedrons sub-frames are connected and, in fact, spanwise cable elements 54, and 58 are common to adjacent frames 36 of adjacent sections 12*b* and 12*c*. The rectahedron sub-frames are connected lengthwise end to end as well within a unit section 12 and cable elements 68, and 70 are common to two successive hectahedron sub-frames 36. The resulting cable framework is a three-dimensional bridge structure having an overall arch shape. Each node 38, 40, 42, 44, 46, 48, 50 and 52 is connected to a respective anchor position 34 on the anchoring skirts 30 and 32 respectively of each seam 26 or 28. Thus, when the envelope 11 is inflated, the top strips 22 tend to pull apart from bottom strips 24 but are held in place by the pulling of the skirts 30 and 32 which in turn, through the anchor rings 34, pull on the nodes of the rectahedron sub-frame inducing tension in the vertical cable elements 62, 64, 66, and 68, proportionally according to the internal air pressure and the area of cross-section covered by one such cable element. With pneumatic air pressure acting in all directions, tension will also be similarly induced in the spanwise cables as well as in the lengthwise cables.

Figure 4:
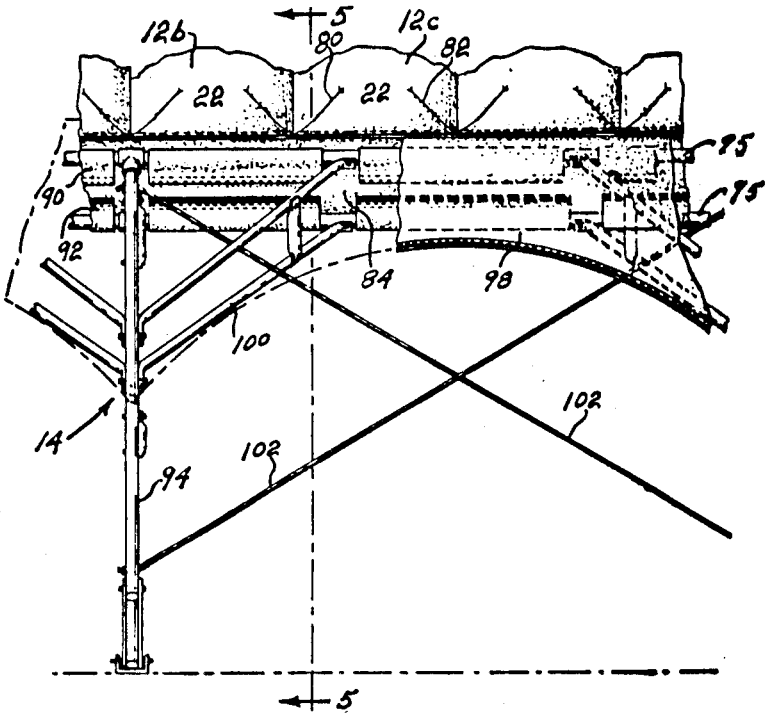
FIG. 4 is a fragmentary view, partly in cross-section, showing the side supports.
Figure 5:
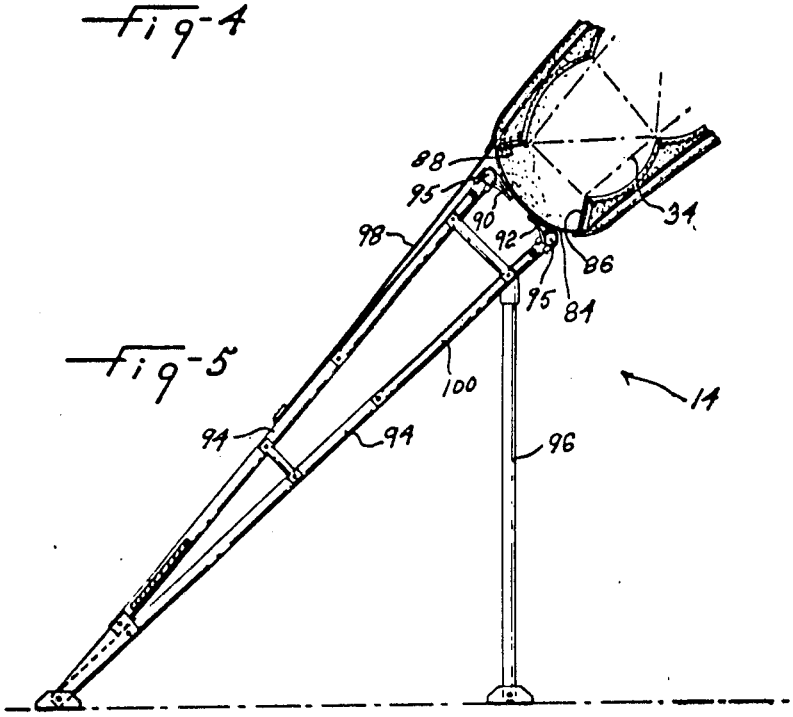
FIG. 5 is a vertical cross-section taken along line 5—5 of FIG. 4.

Reference will now be made to FIGS. 4 and 5 which show the end configuration of each section. Each of the strips 22 and 24 are pleated near the end corners at 80 and 82 and sewn so as to give the strip an arch shape at its ends and is sewn directly to both end panel 84, which extend along the longitudinal sides of the top and bottom panels 16 and 18 and is sewn to the top strips 22 and the bottom strips 24 respectively. The last rectahedron sub-frames 36 of the cable framework are attached to end skirts 86 and 88 which extend along the connection seam between top and bottom panels 16 and 18 and end panels 84 respectively. The end panels 84 include loops 90 and 92 which are adapted to receive the tubular ramp members 95 of side supports 14. The side support includes a succession of tubular frame supports 94 and a vertical stabilizer supports 96. The ends of the supports 94 and 96 must be anchored solidly to the ground to counteract any upward or lateral forces exerted thereon by the envelope 11 as a result of wind lift. Furthermore, a large tension skirt 98 may also be provided to structurally connect the supports 94 to the side edges of the pneumatic structural envelope. A suitable bracing 100 is also provided between support members 94 and ramp members 95 as well as extending flexible cable cross-bracing 102 between adjacent support frames 94.

The end sections 12*a* and 12*n* of the envelope 11 are closed by end caps, also made of canvas material, by sewing its edges to the outside edges of strips 22 and 24 by means of a seam similar to seams 26 and 28 and also bearing skirts similar to skirts 30 and 32, to anchor on the outermost upper and lower nodes of the cable framework respectively to complete the air tight envelope 11.

I claim:

1. An inflatable double wall pneumatic structure including a polyhedron cable frame assembly, said frame comprising a pair of grids in spaced apart respective planes, each grid being made up of first cable tension elements extending in one direction and second intersecting cable members extending in a direction transverse to the direction of the first cable members to form quadrilateral patterns, each first cable element connected to intersecting second cable tension elements at nodes in the plane of each said grid; third cable tension elements extending between the planes of the respective grids and connected to corresponding nodes in the said grids; the grids defining upper and lower surfaces of said cable frame, and an air impervious flexible closed envelope totally enclosing said cable frame, said envelope including top and bottom panels including spaced-apart anchor means connected to corresponding nodes on the grids in the respective planes of the cable frame such that when the envelope is inflated and subject to pneumatic pressure, the first, second and third tension elements forming said cable frame will be under tension causing the cable frame to assume its intended shape.

2. A structure as defined in claim 1, where the cable frame and envelope will assume a parabolic arch shape composed of a larger number of adjacent individual rectahedron shape sub-frames sharing common third cable tension elements at their sides and common nodes; the envelope is slightly oversized and is restricted in its expansion by the anchor means attaching spaced-apart points on the top and bottom panels of the envelope to respective nodes on the cable frame.

3. An inflatable structure as defined in claim 1, wherein the first, second and third cable tension elements are flexible cables.

4. An inflatable structure as defined in claim 2, wherein the envelope is made up of strips of air impervious woven material connected edge to edge with adjacent strips, each strip extends in the longitudinal direction of the sub-frame with one strip corresponding to each upper and lower surface of the sub-frames, the edge to edge connection formed by seams, a continuous skirt at each seam extending inwardly of the envelope to which are attached said anchor means, said strips forming arches across the sub-frames from seam to seam.

5. An inflatable structure as defined in claim 1, wherein said third cable tension elements extend directly from a node in one grid to a corresponding node in another grid and diagonal third cable tension elements extend from one node in one grid to non-corresponding nodes in the other grid.

6. An inflatable structure as defined in claim 5, wherein all of the first, second and third cable elements from one node to another are individual separate cable tension members.

7. An inflatable structure as defined in claim 5, wherein the first tension members in each plane of the respective grids extending in a predetermined direction are continuous tension elements intercepted by second tension elements at respective nodes.

8. An inflated structure as defined in claim 1, wherein the nodes of one grid are connected to the nodes of the other grid by diagonal third tension elements extending from alternate nodes.

* * * * *